US005437364A

United States Patent [19]

Broskow

[11] Patent Number: 5,437,364

[45] Date of Patent: Aug. 1, 1995

[54] PACKAGE COMPRISING CONTAINERS, CARRIER, AND HANDLE

[75] Inventor: James A. Broskow, Buffalo Grove, Ill.

[73] Assignee: Illinois Tool Works Inc., Glenview, Ill.

[21] Appl. No.: 238,423

[22] Filed: May 5, 1994

[51] Int. Cl.[6] ..... B65D 75/00

[52] U.S. Cl. ..... 206/150; 206/143; 206/162; 294/87.2

[58] Field of Search ..... 206/142, 143, 150, 151, 206/162, 165, 200, 427; 294/87.2

[56] References Cited

U.S. PATENT DOCUMENTS

| | | | |
|---|---|---|---|
| 2,677,460 | 5/1954 | Johnson et al. | 206/162 |
| 3,016,136 | 1/1962 | Poupitch | 206/150 |
| 3,199,908 | 8/1965 | Poupitch | 206/151 |
| 3,305,085 | 2/1967 | Rossi | 294/87.2 |
| 3,330,408 | 7/1967 | Wanderer | 206/150 |
| 3,734,278 | 5/1973 | Kerrigan et al. | 206/150 |
| 3,822,012 | 7/1974 | Weaver | 294/87.2 |
| 4,564,106 | 1/1986 | Shilcock | 206/162 |

FOREIGN PATENT DOCUMENTS

| | | | |
|---|---|---|---|
| 1380238 | 1/1975 | United Kingdom | 206/143 |
| 1388305 | 3/1975 | United Kingdom | 206/143 |

*Primary Examiner*—David T. Fidei
*Attorney, Agent, or Firm*—Schwartz & Weinrieb

[57] ABSTRACT

A package for substantially identical bottles arranged in two longitudinal rows is divided longitudinally by an imaginary plane. A carrier made from a sheet of resilient polymeric material so as to have two longitudinal rows of bottle-receiving apertures, and so as to have a longitudinal row of slots between the aperture rows, is applied to the side walls of the bottles. A handle is folded from a sheet of paperboard material so as to define two handle portions. Each handle portion has a longitudinal row of tabs, each being one of a pair of tabs extending downwardly through one of the slots in the carrier. Each tab has a lower portion, which is longer than the slot for such tab, and a neck portion, which is shorter. The carrier is stretchable so as to permit the lower portions of the tabs to pass through the slots. The handle extends upwardly from the carrier, between neck portions of the respective bottles, and is slotted so as to provide a hand grip. The handle defines generally vertical, expansive surfaces suitable for pricing, barcoding, or other labelling of the package.

18 Claims, 1 Drawing Sheet

PACKAGE COMPRISING CONTAINERS, CARRIER, AND HANDLE

FIELD OF THE INVENTION

This invention pertains to an improved package comprising substantially identical containers, such as bottles for soft drinks or other beverages, together with a carrier and a handle. The handle provides generally vertical, laterally facing, expansive surfaces for pricing, barcoding, or other labelling of the improved package.

BACKGROUND OF THE INVENTION

Commonly, cans, bottles, or other containers for soft drinks or other beverages are marketed in packages comprising four, six, eight, or twelve containers in machine-applied carriers made from single sheets of resilient polymeric material, such as low density polyethylene. The carriers are made, as by die-cutting, so as to have band segments defining container-receiving apertures.

Although such polymeric carriers have many advantages, particularly as compared to predominantly paperboard carriers, such polymeric carriers have some shortcomings. A major shortcoming is that such polymeric carriers do not provide expansive surfaces for pricing, barcoding, or other labelling of the packages.

As exemplified in Poupitch U.S. Pat. No. 2,874,835 and Poupitch U.S. Pat. No. 3,016,136, it has been known to employ separate wire or other handles with such polymeric carriers. Although handles as known heretofore are useful with such polymeric carriers, such known handles do not provide suitable labelling surfaces.

This invention has resulted from efforts to provide an improved package for cans, bottles, or other containers for soft drinks or other beverages.

SUMMARY OF THE INVENTION

This invention provides an improved package comprising substantially identical containers, a carrier made from a single sheet of polymeric material, and a handle made from a separate sheet, such as a sheet of paperboard material. The containers may be bottles, each having a body and a neck extending upwardly from the side wall body. The bottles or other containers are arranged in a generally rectangular array including at least one longitudinal row of containers on each side of an imaginary plane dividing the package longitudinally.

The carrier is made from a single sheet of resilient polymeric material so as to have container-receiving apertures arranged in a generally similar array including at least one longitudinal row of container-receiving apertures on each side of the imaginary plane. The carrier is applied to the containers so that the container-receiving apertures receive the respective containers. If the containers are bottles, it is convenient to refer to the container-receiving apertures as bottle-receiving apertures, and the carrier is applied to the bottles so that the bottle-receiving apertures receive the respective bottles along side walls of the container bodies.

The handle is made from the separate sheet so as to have at least one longitudinal row of tabs. Each tab extends downwardly through one of a longitudinal row of slots in the carrier. The slots extend along an imaginary line in the imaginary plane. The handle extends upwardly from the carrier except that the tabs extend below the carrier. If the containers are bottles, the handle extends upwardly from the carrier, between the necks of the bottles, except that the tabs extend below the carrier. The handle defines generally vertical, expansive surfaces suitable for pricing, barcoding, or other labelling of the package.

Preferably, the handle is folded from a sheet of paperboard material so as to define two handle portions extending downwardly from a folded, upper edge of the handle. Each handle portion has a longitudinal row of tabs. Each tab is one of a pair of tabs extending through one of the longitudinal row of slots in the carrier.

Preferably, each tab has a lower portion that is longer than the slot through which such tab extends and a neck portion that is shorter than the slot through which such tab extends, the carrier being stretchable so as to permit the lower portions of the tabs to pass through the slots.

BRIEF DESCRIPTION OF THE DRAWINGS

These and other objects, features, and advantages of this invention will become evident from the following description of a preferred embodiment of this invention with reference to the accompanying drawings, in which like reference characters designate like or corresponding parts of the invention throughout the several views, and wherein.

DETAILED DESCRIPTION OF PREFERRED EMBODIMENT

Figure 1:
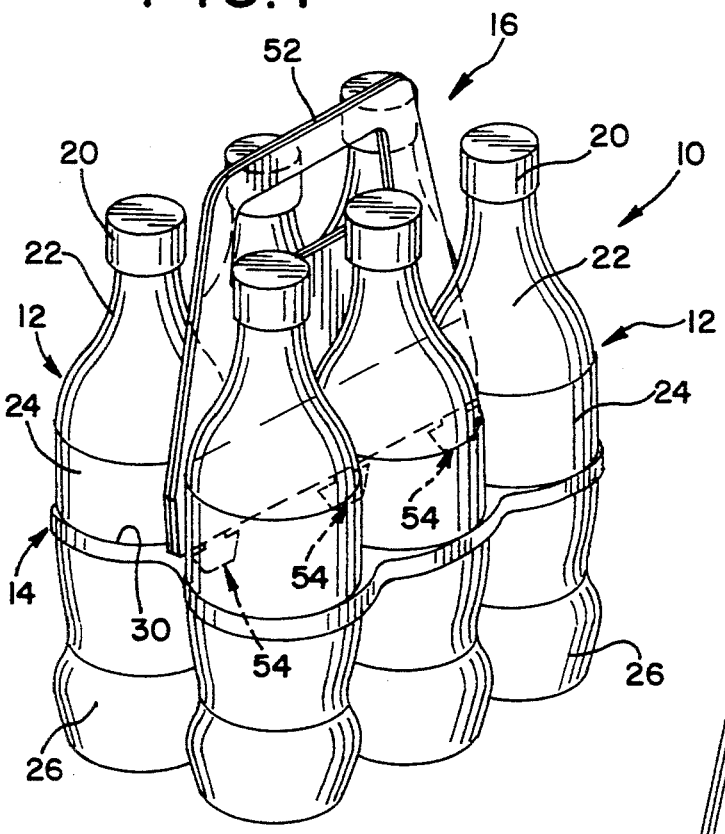
FIG. 1 is a perspective view of a package embodying this invention and comprising six substantially identical bottles, a polymeric carrier, and a paperboard handle.
Figure 2:
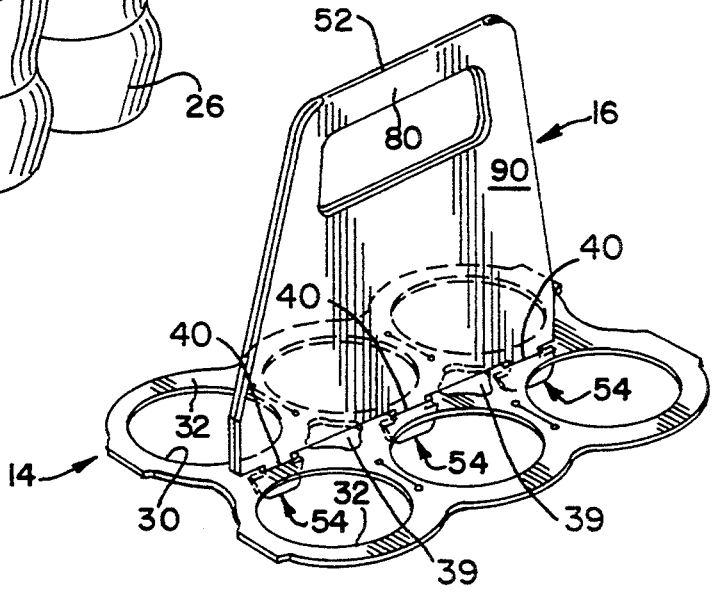
FIG. 2 is a perspective view of the carrier and the handle, as assembled, apart from the bottles.
Figure 4:
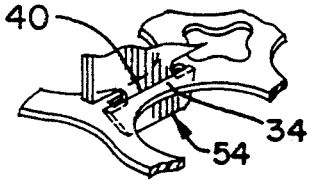
FIG. 4 is an enlarged, fragmentary detail, as taken from FIG. 2.
Figure 3:
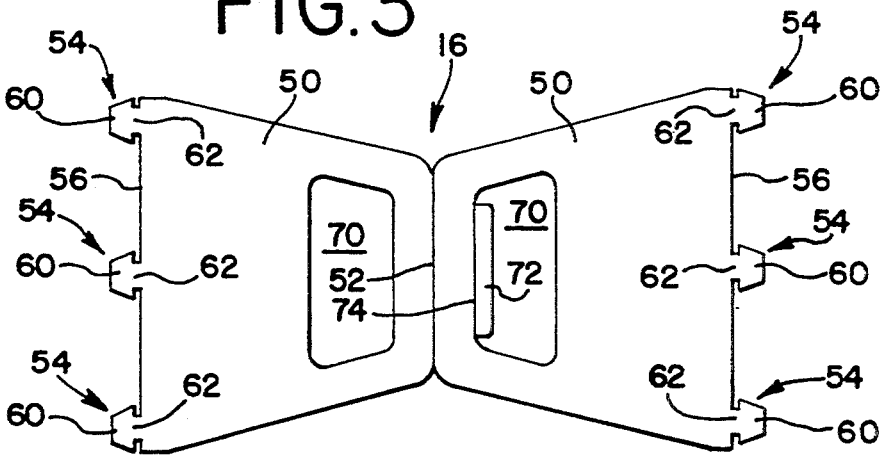
FIG. 3 is a plan view of the handle in an unfolded condition.

As shown, a package 10 comprising six substantially identical bottles 12, a polymeric carrier 14, and a paperboard handle 16 constitutes a preferred embodiment of this invention. The bottles 12 are arranged in a generally rectangular array including two longitudinal rows on each side of an imaginary plane dividing the package 10 longitudinally. As shown, each row includes three bottles 12. This invention contemplates that the generally rectangular array may include more than two rows, a different number of bottles 12 in each row, or both.

The bottles 12 may be predominantly polymeric bottles containing soft drinks. Each bottle 12 has a removable cap 20, which is mounted on a neck 22 of such bottle 12, a body which comprises an annular side wall 24, which is disposed below the neck 22, and a base 26, which is disposed below the side wall 24.

The carrier 14 is made, as by die-cutting, from a single sheet of resilient polymeric material. A preferred material is low density polyethylene. A preferred thickness for such material, if low density polyethylene is used, is about 16 mils. Any of various known carriers made from carrier stock available commercially from ITW Hi-Cone (a division of Illinois Tool Works Inc.) of Itasca, Ill., may be suitably used as the carrier 14.

The carrier 14 is made so as to have band segments defining bottle-receiving apertures 30 and including outer band segments 32 and inner band segments 34. The carrier 14 is made so as to have conventional finger notes 39, and a longitudinal row of three slots 40 extending along an imaginary line in the imaginary plane. Each slot 40 is located in one of the inner band segments 34, between two of the bottle-receiving apertures 30. The carrier 14 is applied to the bottles 12, as by known machinery, so that the bottle-receiving apertures 30 receive the respective bottles 12 and so that the outer band segments 32 embrace portions of the side walls 24 of the bottles 12 in the outer rows. Suitable carrier-applying machinery is available commercially from ITW Hi-Cone, supra.

The handle 16 is made, as by die-cutting, from a sheet of paperboard material. The handle 16 is folded so as to define two handle portions 50, which are mirror images of each other except as noted below, and which extend downwardly from a folded, upper edge 52. Each handle portion 50 has a longitudinal row of three tabs 54 extending downwardly from a lower edge 56 of such handle portion 50. The handle 50 is folded so that each tab 54 is one of a pair of tabs 54 adjacent to each other. After the handle 16 has been folded along the edge 52, the handle portions 50 may be but do not have to be adhesively secured to each other. The handle 16 has three pairs of tabs 54. The tabs 54 of each pair extend downwardly through a respective one of the three slots 40. The handle 16 extends upwardly from the carrier 14, between the necks 22 of the bottles 12, except that the tabs 54 extend below the carrier 14.

Each tab 54 has a shape resembling a blunt arrowhead. Thus, each tab 54 has a lower portion 60 that is longer than the slot 40 through which the tabs 54 of the pair including such tab 54 extend. Also, each tab 54 has a neck portion 62 that is shorter than the same slot 40. Being made from a resilient, polymeric material, such as low density polyethylene, the carrier 14 is stretchable so as to permit the lower portions 60 of the tabs 54 to pass through the slots 40.

The handle 16 is made so as to have a long, wide, generally trapezoidal slot 70 in each handle portion 50 and so as to have a flap 72, which can be folded along a folded, upper edge 74 of the slot 70 in one of the handle portions 50. When the handle 16 is folded along the edge 52 and the flap 72 is folded along the edge 74 so as to extend through the slots 70 of the handle portions 50, the handle 16 defines a hand grip 80 above the slots 70, which are sufficiently long and sufficiently wide to accommodate four fingers of one hand of a user. The flap 72 enables the hand grip 80 to be comfortably gripped.

Advantageously, the handle 16 provides generally vertical, laterally facing, expansive surfaces 90 for pricing, barcoding, or other labelling of the package 10. Such labelling may be imprinted on the paperboard material of the handle 16, drawn thereon by a marker, or applied by means of an adhesive label or otherwise.

Various modifications may be made in the preferred embodiment described above without departing from the scope and spirit of this invention. It is therefore to be understood that within the scope of the appended claims, the present invention may be practiced otherwise than as specifically described herein.

I claim:

1. A package, comprising:

a plurality of substantially identical containers arranged in a substantially rectangular array including at least one longitudinal row of containers disposed upon each side of a plane dividing said package longitudinally;

a carrier comprising a single sheet of resilient polymeric material and having container-receiving apertures arranged in a substantially rectangular array including at least one longitudinal row of container-receiving apertures disposed upon each said of said plane for respectively receiving said containers when said carrier is applied to said containers;

hole means defined within said carrier at a position located between a set of four of said container-receiving apertures for permitting a user to insert at least one finger therein in order to permit said package to be carried by said carrier; and a handle comprising a separate sheet and having at least one longitudinal row of tabs extending downwardly for respectively extending through a longitudinal row of slots defined within said carrier at positions interposed between adjacent pairs of said container-receiving apertures and along said plane, and extending upwardly above said carrier so as to define substantially vertical, expansive planar surfaces suitable for labelling said package and to permit said package to be carried by said handle.

2. The package of claim 1 wherein each tab has a lower portion that is longer than the slot through which said tab extends downwardly and a neck portion that is shorter than the slot through which said tab extends and wherein the carrier is stretchable so as to permit the lower portions of the tabs to pass through the slots.

3. The package of claim 1 wherein the handle is folded from a sheet of paperboard material so as to define two handle portions extending downwardly from a folded, upper edge of the handle, wherein each handle portion has a longitudinal row of tabs, and wherein each tab of each handle portion is one of a pair of tabs extending through one of the longitudinal row of slots in the carrier.

4. The package of claim 3 wherein each tab has a lower portion that is longer than the slot through which said tab extends and a neck portion that is shorter than the slot through which said tab extends and wherein the carrier is stretchable so as to permit the lower portions of the tabs to pass through the slots.

5. A package, comprising:

a plurality of substantially identical bottles arranged in a substantially rectangular array including at least one longitudinal row of bottles disposed upon each side of a plane dividing said package longitudinally, each bottle having a side wall and a neck extending upwardly from said side wall;

a carrier comprising a sheet of resilient polymeric material and having bottle-receiving apertures arranged in a substantially rectangular array including at least one longitudinal row of bottle-receiving apertures disposed upon each side of said plane for respectively receiving said bottles around said side walls of said bottles when said carrier is applied to said bottles;

hole means defined within said carrier at a position located between a set of four of said bottle-receiving apertures for permitting a user to insert at least one finger therein in order to permit said package to be carried by said carrier; and a handle folded from a sheet of paperboard material so as to have two handle portions extending downwardly from a folded, upper edge of said handle, each handle portion having a longitudinal row of tabs extending downwardly for respectively extending through a longitudinal row of slots defined within said carrier at positions interposed between adjacent pairs of said bottle-receiving apertures and along said plane, said handle extending upwardly above said carrier and between said necks of said respective bottles so as to define substantially vertical, expansive planar surfaces suitable for labelling said package and to permit said package to be carried by said handle.

6. The package of claim 5 wherein the handle is slotted so as to define a hand grip.

7. A package, comprising:

a plurality of substantially identical containers arranged in a substantially rectangular array including at least one longitudinal row of containers disposed upon each side of a plane dividing said package longitudinally;

a carrier comprising a single sheet of resilient polymeric material and having container-receiving apertures arranged in a substantially rectangular array including at least one longitudinal row of containers-receiving apertures disposed upon each side of said plane for respectively receiving said containers when said carrier is applied to said containers;

a longitudinal row of slots defined within said carrier along said plane and interposed between adjacent pairs of said container-receiving apertures disposed upon opposite sides of said plane so as to be substantially aligned with centers of said container-receiving apertures; and a handle comprising a separate sheet and having at least one longitudinal row of tabs extending downwardly for respectively extending through said longitudinal row of slots defined within said carrier, and extending upwardly above said carrier so as to define substantially vertical planar surfaces suitable for labelling said package and to permit said package to be carried by said handle.

8. The package as set forth in claim 1, wherein:

said handle is slotted so as to define a hand grip in order to facilitate carrying said package by said handle.

9. The package as set forth in claim 7, wherein:

said handle is slotted so as to define a hand grip in order to facilitate carrying said package by said handle.

10. The package as set forth in claim 1, wherein:

said carrier is fabricated from polyethylene.

11. The package as set forth in claim 5, wherein:

said carrier is fabricated from polyethylene.

12. The package as set forth in claim 7, wherein:

said carrier is fabricated from polyethylene.

13. The package as set forth in claim 1, wherein:

said handle is fabricated from paperboard.

14. The package as set forth in claim 7, wherein:

said handle is fabricated from paperboard.

15. The package as set forth in claim 1, wherein:

said substantially rectangular array of containers comprises two longitudinal rows of containers with each row of containers comprising three containers.

16. The package as set forth in claim 5, wherein:

said substantially rectangular array of bottles comprises two longitudinal rows of bottles with each row of bottles comprising three bottles.

17. The package set forth in claim 7, wherein:

said substantially rectangular array of containers comprises two longitudinal rows of containers with each row of containers comprising three containers.

18. The package as set forth in claim 14, wherein:

said handle comprises said sheet of paperboard which is folded in half upon itself so as to define two handle portions extending downwardly from a folded, upper edge of said handle, and wherein each handle portion is provided with a longitudinal row of said tabs.

* * * * *